US009562531B2

(12) United States Patent
Yamazaki

(10) Patent No.: US 9,562,531 B2
(45) Date of Patent: Feb. 7, 2017

(54) NEGATIVE PRESSURE PUMP AND CYLINDER HEAD COVER

(71) Applicant: SANOH INDUSTRIAL CO., LTD., Tokyo (JP)

(72) Inventor: Nobushi Yamazaki, Ibaraki (JP)

(73) Assignee: SANOH INDUSTRIAL CO., LTD., Tokyo (JP)

( * ) Notice: Subject to any disclaimer, the term of this patent is extended or adjusted under 35 U.S.C. 154(b) by 0 days.

(21) Appl. No.: 14/888,959

(22) PCT Filed: Sep. 11, 2014

(86) PCT No.: PCT/JP2014/074135
§ 371 (c)(1),
(2) Date: Nov. 4, 2015

(87) PCT Pub. No.: WO2015/076001
PCT Pub. Date: May 28, 2015

(65) Prior Publication Data

US 2016/0084252 A1 Mar. 24, 2016

(30) Foreign Application Priority Data

Nov. 22, 2013 (JP) ..... 2013-242292

(51) Int. Cl.
*F04C 18/344* (2006.01)
*F04C 25/02* (2006.01)
(Continued)

(52) U.S. Cl.
CPC ..... *F04C 29/12* (2013.01); *F01C 21/106* (2013.01); *F04C 18/344* (2013.01);
(Continued)

(58) Field of Classification Search
CPC ... F01C 21/106; F04C 18/344; F04C 18/3442; F04C 18/3448; F04C 25/02; F04C 29/02; F04C 29/028; F04C 29/12; F04C 2240/56; F04C 2240/60
(Continued)

(56) References Cited

U.S. PATENT DOCUMENTS 3,499,600 A * 3/1970 McGregor ..... F01C 21/106 418/150
4,516,918 A 5/1985 Drutchas et al.
(Continued)

FOREIGN PATENT DOCUMENTS

JP 59-28081 2/1984
JP 2004-263690 A 9/2004
(Continued)

OTHER PUBLICATIONS

Search Report and Written Opinion in International Application No. PCT/JP2014/074135 dated Nov. 25, 2014.

*Primary Examiner* — Nicholas J Weiss
*Assistant Examiner* — Dapinder Singh
(74) *Attorney, Agent, or Firm* — Marshall, Gerstein & Borun LLP

(57) ABSTRACT

A negative pressure pump has: a housing; a rotating shaft having a shaft portion, and a supporting portion; a vane that is supported at the supporting portion so as to freely move reciprocally in a direction orthogonal to the rotating shaft, and that rotates integrally with the rotating shaft, and whose end portions slide on an inner wall surface, and that sections an interior of the housing into plural spaces; an intake portion that is formed in the housing; a discharging portion that is formed further toward a vane rotating direction downstream side than the intake portion; and a concave portion that is formed in a bottom surface between the discharging portion and a curved surface in a vane rotating
(Continued)

direction, and that communicates with a circular hole, and guides the lubricant, that is moved by the vane, to the circular hole.

8 Claims, 14 Drawing Sheets

(51) Int. Cl.

| | |
|---|---|
| ***F04C 29/00*** | (2006.01) |
| ***F04C 29/12*** | (2006.01) |
| ***F04C 29/02*** | (2006.01) |
| ***F01C 21/10*** | (2006.01) |

(52) U.S. Cl.
CPC ..... *F04C 18/3442* (2013.01); *F04C 18/3448* (2013.01); *F04C 25/02* (2013.01); *F04C 29/02* (2013.01); *F04C 29/028* (2013.01); *F04C 2240/56* (2013.01); *F04C 2240/60* (2013.01)

(58) Field of Classification Search
USPC ..... 418/88, 112, 188, 255
See application file for complete search history.

(56) References Cited

U.S. PATENT DOCUMENTS

| | | | | |
|---|---|---|---|---|
| 7,588,433 | B2 * | 9/2009 | Kishi | F04C 18/3442 418/112 |
| 8,449,277 | B2 * | 5/2013 | Sakakibara | F04C 18/3441 418/188 |
| 2008/0159896 | A1 * | 7/2008 | Kishi | F04C 18/3442 418/88 |

FOREIGN PATENT DOCUMENTS

| | | | |
|---|---|---|---|
| JP | 2004-285978 | A | 10/2004 |
| JP | 2006-226166 | A | 8/2006 |
| JP | 2012-36807 | | 2/2012 |
| WO | WO-2006/122516 | A1 | 11/2006 |

* cited by examiner

NEGATIVE PRESSURE PUMP AND CYLINDER HEAD COVER

TECHNICAL FIELD

The present invention relates to a negative pressure pump and a cylinder head cover.

BACKGROUND ART

A vane-type negative pressure pump that generates negative pressure due to power from an engine is disclosed in Japanese Patent Application Laid-Open (JP-A) No. 2004-285978. In this negative pressure pump, a rotor that supports a vane is passed-through the bottom portion of a housing that is shaped as a cylinder having a bottom, and the outer peripheral surface of this rotor contacts a portion of the inner wall surface of the housing. Further, in the bottom portion of the housing, an intake port is formed, and a discharging port is formed at the vane rotating direction downstream side of this intake port, respectively. Further, a notch that, at the time when the vane that has gone past the discharging port compresses the space between the rotor, becomes a relief passage for releasing gas and lubricant from the compressed space to a space (a space including the intake port) where the pressure is lower than the compressed space, is formed in the outer peripheral surface of the rotor. Excessive pressure (force that attempts to push the vane back) being applied to the vane is suppressed by this notch.

SUMMARY OF INVENTION

Technical Problem

However, in JP-A No. 2004-285978, because gas and lubricant are released from the compressed space to the space where the pressure is low, the volume of the space where the pressure is low is filled-up by the gas and the lubricant and that were released, and the amount of air that can be sucked-in from the intake port decreases, and the pump efficiency decreases.

A subject of the present invention is to provide a negative pressure pump and a cylinder head cover that suppress a decrease in pump efficiency while suppressing application of excessive pressure to a vane.

Solution to Problem

A negative pressure pump of a first aspect of the present invention comprises: a housing that is formed in a shape of a tube having a bottom, and at which an opening portion is blocked by a cover body, and to whose interior lubricant is supplied, and in which a circular hole is formed at a position of a bottom portion, the position being eccentric from a housing center; a rotating shaft having a shaft portion that is fit-together with the circular hole, and having a supporting portion, whose diameter is larger than the shaft portion and that is disposed within the housing and whose outer peripheral surface contacts a portion of an inner wall surface of the housing, the rotating shaft rotating due to power being transmitted thereto from a power source; a vane that is disposed within the housing, and that is supported at the supporting portion of the rotating shaft so as to freely move reciprocally in a direction orthogonal to the rotating shaft, and that rotates integrally with the rotating shaft, and whose end portions slide on the inner wall surface, and that sections an interior of the housing into a plurality of spaces; an intake portion that is formed in the housing and takes a gas into the housing; a discharging portion that is formed further toward a rotating direction downstream side of the vane than the intake portion of the housing, and that discharges gas, that has been sucked-in from the intake portion, and the lubricant to an exterior of the housing; and a concave portion that is formed in a bottom surface of the housing and, in a rotating direction of the vane, between the discharging portion and a portion of the inner wall surface that the supporting portion contacts, and that communicates with the circular hole, and guides the lubricant, that is moved by the vane, to the circular hole.

In the negative pressure pump of the first aspect, when power is transmitted from the power source and the rotating shaft rotates, the vane also rotates integrally with the rotating shaft. Due to this rotation, the vane receives centrifugal force and moves in the direction (the diameter direction of the rotating shaft) orthogonal to the rotating shaft, and the vane end portions slide on the inner wall surface of the housing.

Further, because the shaft portion of the rotating shaft is fit-together with the circular hole that is eccentric from the housing center, the rotational center of the rotating shaft is at a position that is eccentric with respect to the housing center. Therefore, when the rotating shaft and the vane rotate integrally, the volumes of the spaces that are sectioned by the vane increase and decrease. Here, at the spaces sectioned by the vane, first, at the time of an increase in the volume, a gas is sucked-in from the intake portion, and next, at the time of a decrease in the volume, the gas that was sucked-in is discharged from the discharging portion while being compressed. In this way, due to a gas being sucked-in from a device that is connected to the intake portion, negative pressure can be generated at the device side.

In the above-described negative pressure pump, the concave portion is formed in the bottom surface of the housing and, in the rotating direction of the vane, between the discharging portion and the portion of the inner wall surface that the supporting portion contacts. Therefore, the lubricant, that remains without having been completely discharged-out after the vane has gone past the discharging portion, enters into the concave portion. Because this concave portion communicates with the circular hole, the lubricant that has entered-in is guided to the circular hole. Here, at the space (hereinafter called "closed space") between the rotating shaft (the supporting portion) and the vane that has gone past the discharging portion, the pressure rises due to the decrease in volume, and therefore, the lubricant, that has been guided to the circular hole, is pushed-into the gap between the circular hole and the shaft portion by the pressure of the closed space. At this time, the gas, that remains without having been completely discharged-out, also mixes with the lubricant, and is pushed-into the aforementioned gap. Due thereto, a rise in pressure of the closed space is suppressed, and therefore, excessive pressure being applied to the vane is suppressed.

Further, frictional resistance between the circular hole and the shaft portion is decreased by the lubricant that has been pushed-into the gap between the circular hole and the shaft portion. Due thereto, wear of the circular hole and the shaft portion is suppressed. Moreover, because rotation of the rotating shaft is smooth due to the lubricant, energy loss of the power source also is suppressed.

Moreover, due to the rotation of the vane, lubricant and gas successively pass-through the concave portion and are pushed-into the aforementioned gap, and then, are pushed-out to the exterior of the housing. Therefore, effects of the lubricant, that remains without having been completely discharged-out, on the intake amount of the gas that is sucked-in from the intake portion (the sucked-in amount) are reduced, and thus, a decrease in the pump efficiency can be suppressed.

Due to the above, in accordance with the negative pressure pump of the first aspect, a decrease in the pump efficiency can be suppressed while the application of excessive pressure to the vane is suppressed.

A negative pressure pump of a second aspect of the present invention comprises: a housing that is formed in a shape of a tube having a bottom, and at which an opening portion is blocked by a cover body, and to whose interior lubricant is supplied, and in which a circular hole is formed at a position of a bottom portion, the position being eccentric from a housing center; a rotating shaft having a shaft portion that is fit-together with the circular hole, and having a supporting portion, whose diameter is larger than the shaft portion and that is disposed within the housing, the rotating shaft rotating due to power being transmitted thereto from a power source; three or more vanes that are disposed within the housing, and that are supported at the supporting portion of the rotating shaft so as to freely move reciprocally in a direction orthogonal to the rotating shaft, and that rotate integrally with the rotating shaft, and whose end portions slide on an inner wall surface of the housing, and that section an interior of the housing into a plurality of spaces; an intake portion that is formed in the housing and takes a gas into the housing; a discharging portion that is formed further toward a rotating direction downstream side of the vanes than the intake portion of the housing, and that discharges gas, that has been sucked-in from the intake portion, and the lubricant to an exterior of the housing; and a concave portion that is formed in a bottom surface of the housing and, in a rotating direction of the vanes, between the discharging portion and the intake portion, and that communicates with the circular hole, and guides the lubricant, that is moved by the vanes, to the circular hole.

In the negative pressure pump of the second aspect, when power is transmitted from the power source and the rotating shaft rotates, the vanes also rotate integrally with the rotating shaft. Due to this rotation, the vanes receive centrifugal force and move in the direction (the diameter direction of the rotating shaft) orthogonal to the rotating shaft, and the vane end portions slide on the inner wall surface of the housing.

Further, because the shaft portion of the rotating shaft is fit-together with the circular hole that is eccentric from the housing center, the rotational center of the rotating shaft is at a position that is eccentric with respect to the housing center. Therefore, when the rotating shaft and the vanes rotate integrally, the volumes of the spaces that are sectioned by the vanes increase and decrease. Here, at the spaces sectioned by the vanes, first, at the time of an increase in the volume, a gas is sucked-in from the intake portion, and next, at the time of a decrease in the volume, the gas that was sucked-in is discharged from the discharging portion while being compressed. In this way, due to a gas being sucked-in from a device that is connected to the intake portion, negative pressure can be generated at the device side.

In the above-described negative pressure pump, the concave portion is formed in the bottom surface of the housing, between the discharging portion and the intake portion in the rotating direction of the vanes. Therefore, the lubricant, that remains without having been completely discharged-out after the vane has gone past the discharging portion, enters into the concave portion. Because this concave portion communicates with the circular hole, the lubricant that has entered-in is guided to the circular hole. Here, in the space (hereinafter called "closed space") between the vane that has gone past the discharging portion and the vane that went past the discharging portion before that vane and has not yet reached the intake portion, the pressure rises due to a decrease in volume. Therefore, the lubricant, that has been guided to the circular hole, is, by the pressure of the closed space, pushed-into the gap between the circular hole and the shaft portion. At this time, the gas, that remains without having been completely discharged-out, also mixes with the lubricant, and is pushed-into the aforementioned gap. Due thereto, a rise in pressure of the closed space is suppressed, and therefore, excessive pressure being applied to the vanes is suppressed.

Further, frictional resistance between the circular hole and the shaft portion is decreased by the lubricant that has been pushed-into the gap between the circular hole and the shaft portion. Due thereto, wear of the circular hole and the shaft portion is suppressed. Moreover, because rotation of the rotating shaft is smooth due to the lubricant, energy loss of the power source also is suppressed.

Moreover, due to the rotation of the vanes, lubricant and gas successively pass-through the concave portion and are pushed-into the aforementioned gap, and then, are pushed-out to the exterior of the housing. Therefore, effects of the lubricant, that remains without having been completely discharged-out, on the intake amount of the gas that is sucked-in from the intake portion (the sucked-in amount) are reduced, and thus, a decrease in the pump efficiency can be suppressed.

Due to the above, in accordance with the negative pressure pump of the second aspect, a decrease in the pump efficiency can be suppressed while the application of excessive pressure to the vanes is suppressed.

A negative pressure pump of a third aspect of the present invention comprises, in the negative pressure pump of the first aspect, a hole side groove portion that is formed in a hole wall surface of the circular hole, and that communicates the concave portion and the exterior of the housing.

In the negative pressure pump of the third aspect, the hole side groove portion, that communicates the concave portion and the exterior of the housing, is formed in the hole wall surface of the circular hole. Therefore, the lubricant, that has passed-through the concave portion and been guided to the circular hole, is, due to the pressure of the closed space, pushed-into the hole side groove portion that structures the gap between the circular hole and the shaft portion. By forming the hole side groove portion in the hole wall surface of the circular hole in this way, the pushed-out amount of lubricant and gas from the closed space (the discharged-out amount) increases, and therefore, a rise in pressure of the closed space can be further suppressed. Further, a decrease in the pump efficiency also can be suppressed further.

In a negative pressure pump of a fourth aspect of the present invention, in the negative pressure pump of the third aspect, the hole side groove portion is formed in a spiral form that circles in a same direction as the rotating direction of the vane, from a concave portion side of the circular hole toward a side opposite the concave portion.

In the negative pressure pump of the fourth aspect, the hole side groove portion is formed in a spiral form that circles in the same direction as the rotating direction of the vane, from the concave portion side of the circular hole toward the side opposite the concave portion. Therefore, due to rotation of the rotating shaft (the shaft portion), force in the rotating direction of the vane is applied to the lubricant that is within the hole side groove portion. Due thereto, the lubricant passes through the interior of the hole side groove portion, and is guided and discharged-out to the exterior of the housing.

In a negative pressure pump of a fifth aspect of the present invention, in the negative pressure pump of any the first aspect, the concave portion extends from an edge portion of the circular hole to a boundary between the inner wall surface and the bottom surface.

In the negative pressure pump of the fifth aspect, the concave portion extends from the edge portion of the circular hole to the boundary between the inner wall surface and the bottom surface, and therefore, the lubricant that is the vicinity of the boundary also enters into the concave portion. Due thereto, even more lubricant can be discharged-out through the concave portion from the gap between the circular hole and the shaft portion to the exterior of the housing.

A negative pressure pump of a sixth aspect of the present invention comprises, in the negative pressure pump of the first aspect, a shaft side groove portion that is formed in an outer peripheral surface of the shaft portion, and that communicates the concave portion with the exterior of the housing when the vane is positioned between the discharging portion and the portion of the inner wall surface that the supporting portion contacts.

In the negative pressure pump of the sixth aspect, the shaft side groove portion, that communicates the concave portion and the exterior of the housing when the vane is positioned between the discharging portion and the portion of the inner wall surface that the supporting portion contacts, is formed in the outer peripheral surface of the shaft portion. Therefore, the lubricant, that has passed-through the concave portion and been guided to the circular hole, is, by the pressure of the closed space, pushed-into the shaft side groove portion that structures the gap between the circular hole and the shaft portion. By forming the shaft side groove portion in the outer peripheral surface of the shaft portion in this way, the pushed-out amount of lubricant and gas from the closed space (the discharged-out amount) increases, and therefore, a rise in pressure of the closed space can be further suppressed. Further, a decrease in the pump efficiency also can be suppressed further.

In a negative pressure pump of a seventh aspect, in the negative pressure pump of the sixth aspect, the shaft side groove portion is formed in a spiral form that circles in a direction that is opposite from the rotating direction of the vane, from a supporting portion side of the shaft portion toward a side that is opposite from the supporting portion.

In the negative pressure pump of the seventh aspect, the shaft side groove portion is formed in a spiral form that circles in the direction opposite the rotating direction of the vane, from the supporting portion side of the shaft portion toward the side opposite the supporting portion. Therefore, due to rotation of the rotating shaft (the shaft portion), force in the direction opposite the rotating direction of the vane is applied to the lubricant that is within the shaft side groove portion. Due thereto, the lubricant passes through the interior of the shaft side groove portion and is guided and discharged-out to the exterior of the housing.

A cylinder head cover of an eighth aspect of the present invention comprises the negative pressure pump of the first aspect in which, a portion of the cylinder head cover structures the housing, and another portion of the cylinder head cover covers a cylinder head of an engine that serves as the power source.

In the cylinder head cover of the eighth aspect, because a portion of the cylinder head cover structures the housing, manufacturing costs can be decreased as compared with, for example, a structure in which the cylinder head cover and the housing of the negative pressure pump are made to be separate. Further, because the cylinder head cover has the negative pressure pump of the first aspect, the cylinder head cover exhibits the operation and effects obtained by this negative pressure pump.

Advantageous Effects of Invention

In accordance with the negative pressure pump and cylinder head cover of the present invention, a decrease in pump efficiency can be suppressed while application of excessive pressure to a vane is suppressed.

DESCRIPTION OF EMBODIMENTS

First Embodiment

A negative pressure pump relating to a first embodiment of the present invention is described.

A negative pressure pump 10 (see FIG. 1) of the present embodiment is a device that uses an engine as the power source and generates negative pressure, and is used in a negative pressure-type brake booster device (not illustrated) of a vehicle. Note that the present invention is not limited to the above-described structure, and may use a motor or the like as the power source of the negative pressure pump. Further, the negative pressure pump of the present invention may be used in other than a negative pressure-type brake booster device, provided that the device in which the negative pressure pump of the present invention is used is a device that utilizes negative pressure.

Figure 2:
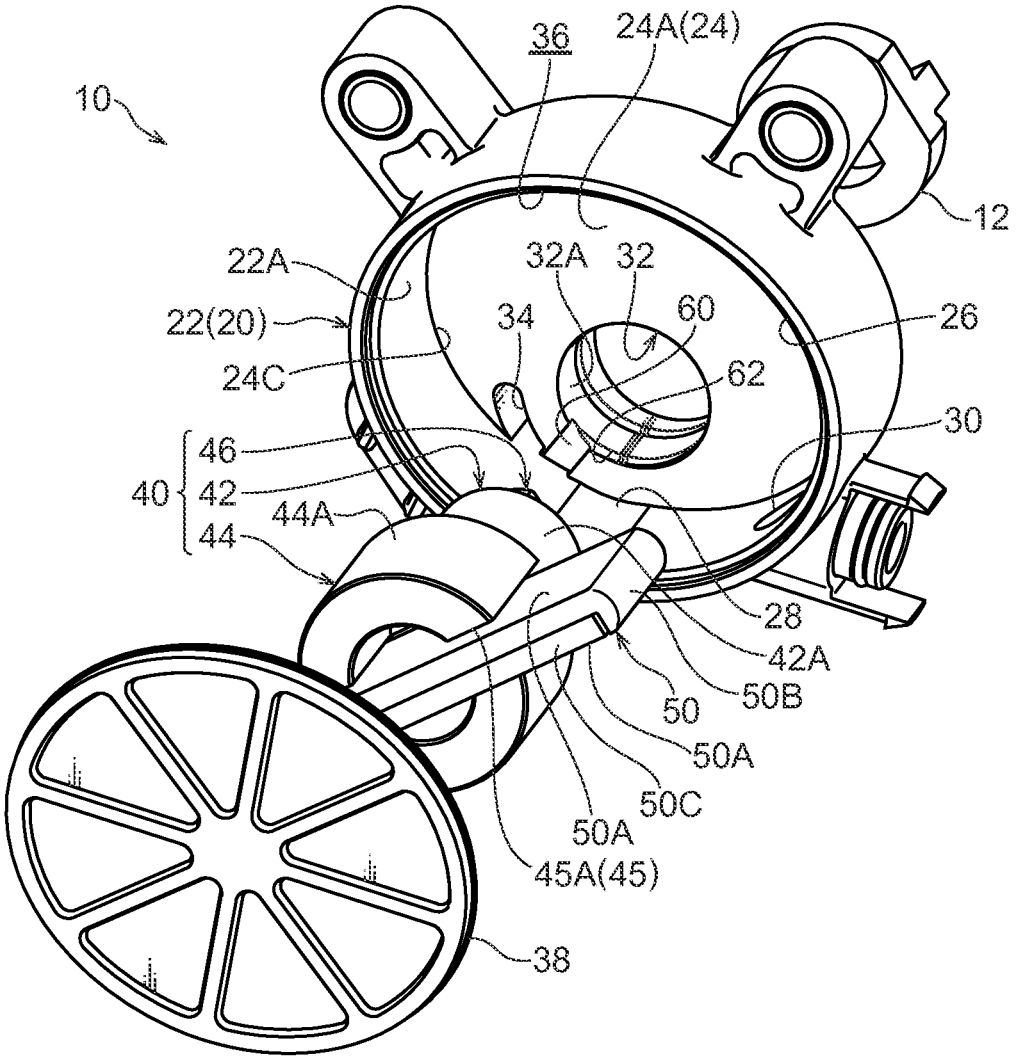
FIG. 2 is an exploded perspective view of the negative pressure pump of FIG. 1.
Figure 3:
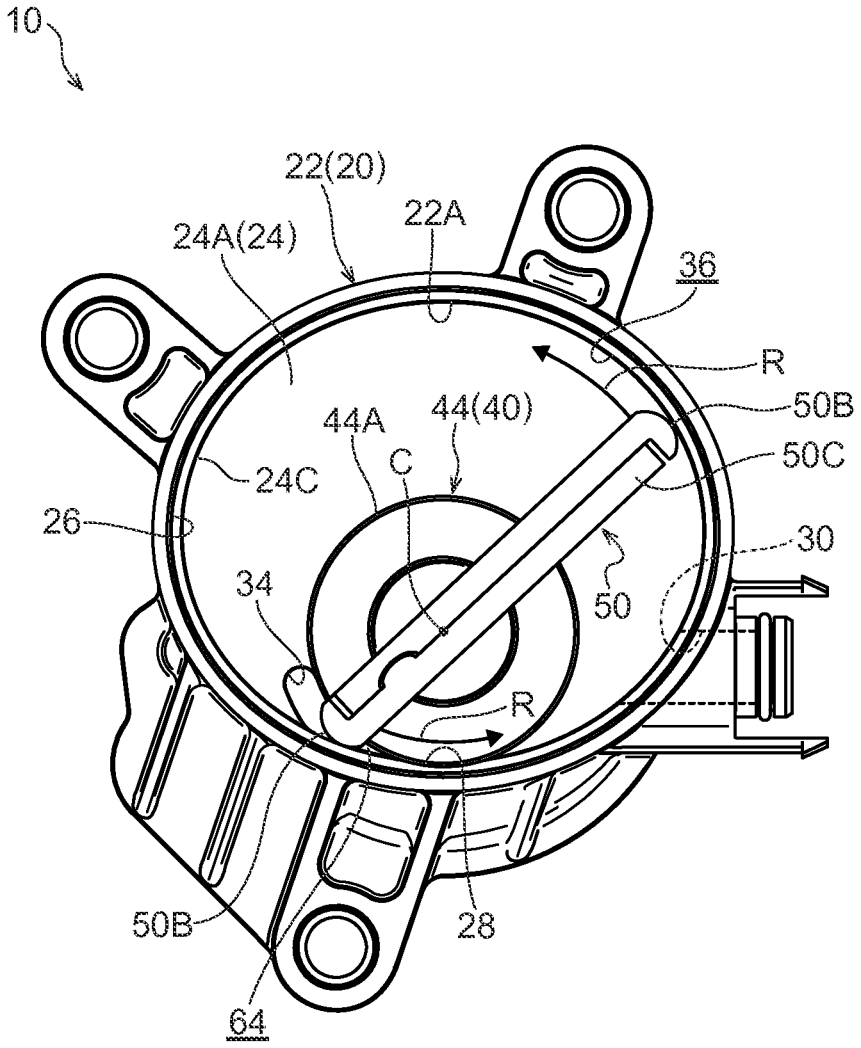
FIG. 3 is a front view of a state in which a cover body has been removed from the negative pressure pump of FIG. 1.

As shown in FIG. 2 and FIG. 3, the negative pressure pump 10 has: a housing 20 that is shaped as a tube that has a bottom, and whose opening portion 26 is blocked by a cover body 38, and to whose interior a lubricant (in the present embodiment, engine oil (a non-compressible fluid) is used an example) is supplied; a rotating shaft 40 whose supporting portion 44 is disposed within the housing 20; a vane 50 that is disposed within the housing 20 and is supported by the supporting portion 44 of the rotating shaft 40; an intake portion 30 of a gas (in the present embodiment, air (a compressible fluid) is used as an example) and a discharging portion 34 of the sucked-in gas that are formed in the housing 20; a concave portion 60 that is formed in a bottom surface 24A of the housing 20; and a hole side groove portion 62 that is formed in a hole wall surface 32A of a circular hole 32.

Note that "shaped as a tube" in the present embodiment includes circular tube shaped, elliptical tube shaped (oval tube shaped), polygonal tube shaped at which the cross-sectional shape of the inner wall surface is a precise circle or an ellipse (an oval), and combined tube shapes in which these tube shapes are combined. Further, "shaped as a tube" also includes tube shapes at which the inner diameter varies along the axial direction.

Figure 4:
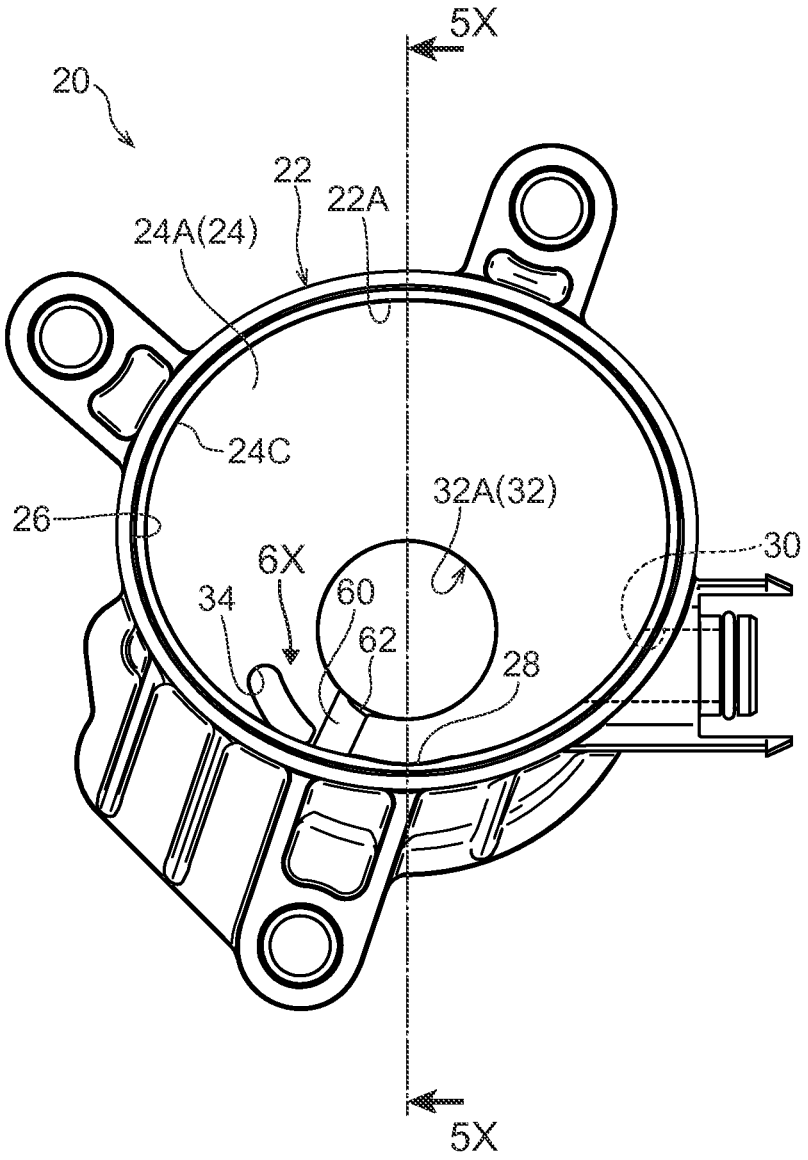
FIG. 4 is a front view of a housing of the negative pressure pump of FIG. 1.
Figure 5:
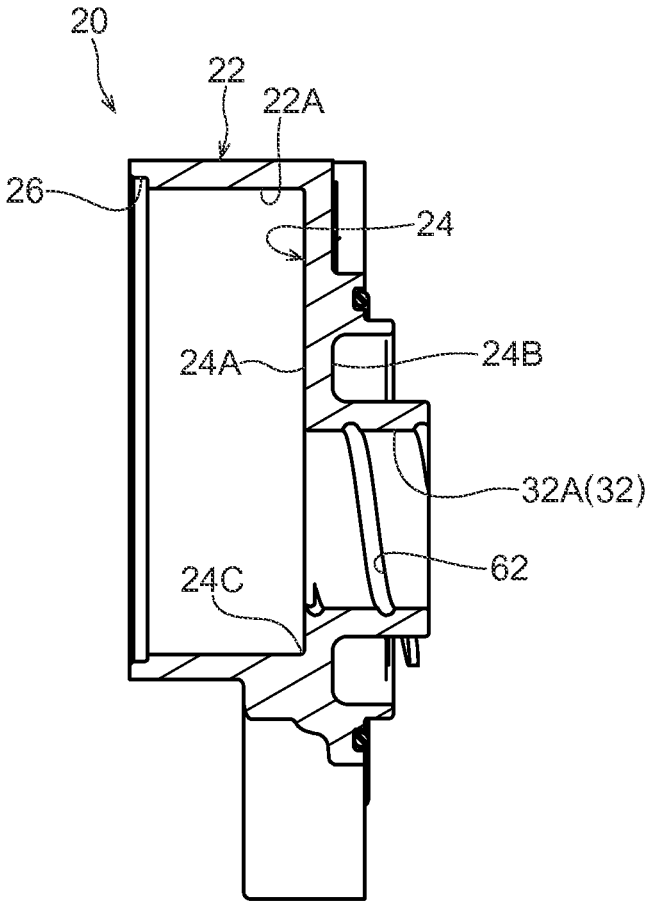
FIG. 5 is a cross-sectional view along line 5X-5X of the housing of FIG. 4.

As shown in FIG. 4 and FIG. 5, the housing 20 that is shaped as a tube having a bottom is structured to include a tubular wall portion 22 that is shaped as a tube, and a bottom portion 24 that blocks the other side (the right side in FIG. 5) in the axial direction of the tubular wall portion 22. One side (the left side in FIG. 5) in the axial direction of the tubular wall portion 22 is open, and structures the opening portion 26 of the housing 20.

As shown in FIG. 4, the cross-sectional shape of an inner wall surface 22A of the tubular wall portion 22 (the housing 20) is an ellipse. An outer peripheral surface 44A of the supporting portion 44 contacts a portion of this inner wall surface 22A. Concretely, a curved surface 28 (see FIG. 2 and FIG. 4), that is a shape that runs along the outer peripheral surface 44A at the portion of the inner wall surface 22A that the outer peripheral surface 44A contacts, is formed at the inner wall surface 22A. This curved surface 28 is curved at the same curvature as the outer peripheral surface 44A.

Further, the intake portion 30, that is an opening portion for taking a gas into the interior of the housing 20, is formed in the tubular wall portion 22. This intake portion 30 is disposed further toward the downstream side in the rotating direction of the vane 50 (hereinafter simply called "vane rotating direction") than the curved surface 28. Note that the vane 50 of the present embodiment is structured so as to, at the time of generating negative pressure, rotate counter-clockwise (in the arrow R direction in FIG. 3) as seen from the cover body 38 side.

Further, there is a structure in which a check valve (not illustrated) that has a checking function, is connected to the intake portion 30. The intake portion 30 and the negative pressure-type brake booster device (not illustrated) are connected via this check valve. Note that the check valve is structured so as to permit flow of gas that heads from the negative pressure-type brake booster device toward the intake portion 30, and stop the flow of gas and lubricant from the intake portion 30 toward the negative pressure-type brake booster device.

As shown in FIG. 4, the bottom portion 24 is plate-shaped, and extends in the direction orthogonal to the axial direction of the tubular wall portion 22. The circular hole 32 is formed in this bottom portion 24 at a position that is eccentric with respect to the housing center (the center of the tubular wall portion 22 (the housing 20)). Further, the thickness (the plate thickness) of the portion of the bottom portion 24 where the circular hole 32 is formed is made to be thicker than the other portions. Due thereto, because the length (the depth) of the circular hole 32 is ensured, the surface area of contact of the hole wall surface 32A of the circular hole 32 and an outer peripheral surface 42A of a shaft portion 42 that is described later (the supporting surface area of the rotating shaft 40) can be sufficiently ensured. Note that the present invention is not limited to this structure, and, for example, the entire thickness of the bottom portion 24 may be made to be thick, and the length of the circular hole 32 ensured.

As shown in FIG. 2, the shaft portion 42 of the rotating shaft 40 is fit-together with the circular hole 32. The outer peripheral surface 42A of this shaft portion 42 contacts the hole wall surface 32A of the circular hole 32, and is supported by this hole wall surface 32A so as to rotate freely.

Further, the discharging portion 34 (see FIG. 3), that is an opening portion for discharging lubricant that is within the housing 20 and gas that has been sucked-in from the intake portion 30, is formed in the bottom portion 24. This discharging portion 34 is disposed further toward the vane rotating direction downstream side than the intake portion 30. Further, the discharging portion 34 is blocked by a discharging valve (not illustrated) that is flexible and is mounted to an outer surface 24B (the surface opposite the bottom surface 24A) of the bottom portion 24. This discharging valve is structured so as to permit the flow of gas and lubricant from the interior of the housing 20 toward the outer side, and to stop the flow of gas and lubricant from the outer side toward the interior of the housing 20.

Figure 1:
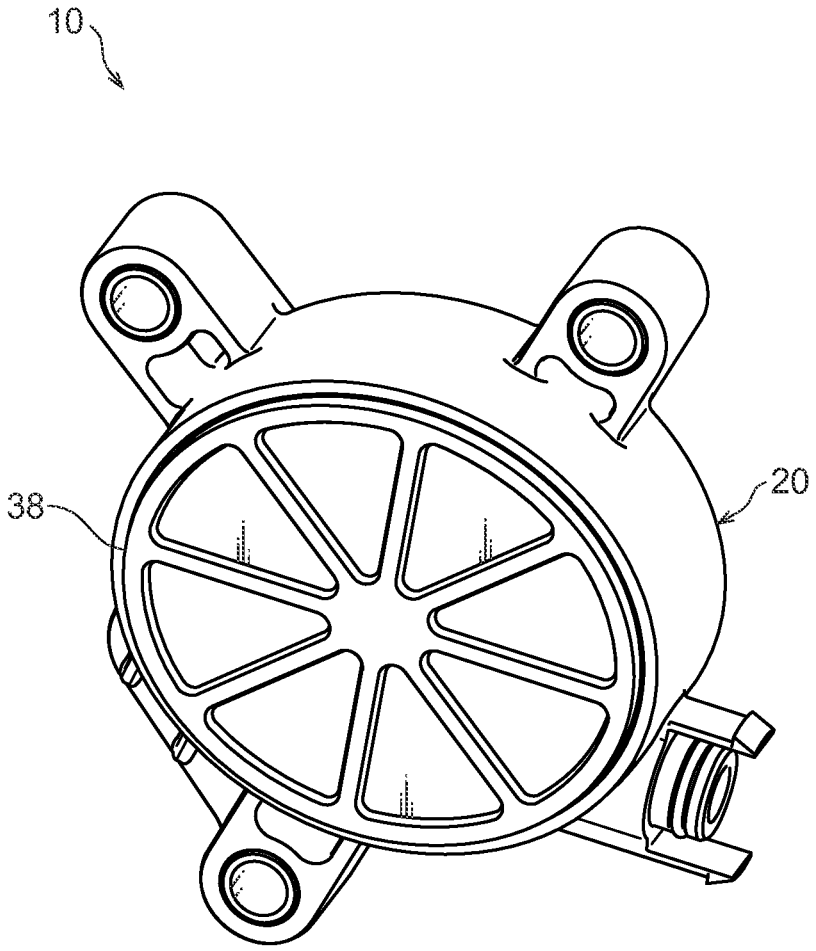
FIG. 1 is a perspective view of a negative pressure pump of a first embodiment of the present invention.

As shown in FIG. 1 and FIG. 2, the cover body 38 that is plate-shaped is attached, so as to be freely attachable and removable, to the opening portion 26 of the housing 20 (see FIG. 1). A sealing member (not illustrated) is disposed at the abutting portion of this cover body 38 and the housing 20. In the state in which the cover body 38 is attached to the housing 20, leaking-out of the gas and the lubricant, that are within the housing 20, from between the cover body 38 and the housing 20 is prevented by this sealing member.

As shown in FIG. 3, in the present embodiment, the internal space of the housing 20 forms a pump chamber 36. Concretely, the pump chamber 36 is structured by the inner wall surface 22A, the bottom surface 24A, and the blocking surface (the reverse surface) of the cover body 38.

Further, in the present embodiment, the housing 20 is formed of resin. Concretely, the housing 20 is made to be an integrally molded part of resin. Either of a thermosetting resin or a thermoplastic resin may be used as the resin that forms the housing 20. Examples of thermosetting resins are, for example, phenol resins, urea resins, melamine resins, epoxy resins, and the like. On the other hand, examples of thermoplastic resins are, for example, urethane resins, olefin resins, vinyl chloride resins, polyacetal resins, polyamide resins, polyimide reins, and the like. Note that, in the present embodiment, the resin that forms the housing 20 is made to be a polyamide resin (e.g., nylon) from the standpoints of toughness and flexibility. Note that the present invention is not limited to this structure, and the housing 20 may be formed from a metal. However, from the standpoints of weight and manufacturing cost, it is preferable to form the housing 20 from a resin.

In the same way as the housing 20, the cover body 38 is formed of resin. The resin that forms the cover body 38 may be the same as, or may be different from, the resin that forms the housing 20. Note that, in the present embodiment, the cover body 38 is formed of the same resin as the resin that forms the housing 20.

As shown in FIG. 2 and FIG. 3, the rotating shaft 40 has the shaft portion 42 that structures the intermediate portion in the axial direction and that is fit-together with the circular hole 32 so as to rotate freely, the supporting portion 44 that structures one end side in the axial direction and that is disposed within the housing 20, and the engaging convex portion 46 that structures the other end side in the axial direction and engages with a coupling joint 12 (e.g., an Oldham coupling or the like) that is mounted to a cam shaft (not illustrated). Note that the shaft portion 42 and the supporting portion 44 are made to be coaxial. Further, in the state in which the shaft portion 42 is fit-together with the circular hole 32, a rotation center C of the rotating shaft 40 is disposed at a position that is eccentric with respect to the housing center (see FIG. 3).

The shaft portion 42 is solid-cylindrical, and is fit-together with the circular hole 32 of the housing 20 so as to rotate freely. A through-hole 48 that extends along the axial direction is formed in the center of this shaft portion 42. This through-hole 48 extends to the distal end of the engaging convex portion 46, and opens at this distal end surface. Further, there is a structure in which lubricant is sent into the through-hole 48 from an internal flow path of the cam shaft (not illustrated). The lubricant that has been sent-in from the cam shaft passes through the through-hole 48 and is supplied to the interior of the pump chamber 36 (the interior of the housing 20). Note that, for the through-hole 48, refer to a rotating shaft 82 of the second embodiment of FIG. 11 and FIG. 12.

The supporting portion 44 is substantially shaped as a cylindrical tube, and is made to have a larger diameter than the shaft portion 42. Further, the supporting portion 44 is disposed within the pump chamber 36 (in the interior of the housing 20), and the outer peripheral surface 44A contacts the curved surface 28 that is formed at the inner wall surface 22A. Concretely, due to rotation of the rotating shaft 40, the outer peripheral surface 44A of the supporting portion 44 slides on the curved surface 28 in the vane rotating direction.

Further, a groove 45, that extends in the direction orthogonal to the axial direction of the rotating shaft 40, i.e., along the diameter direction of the rotating shaft 40, is formed in the supporting portion 44. The supporting portion 44 is divided in half by this groove 45.

The engaging convex portion 46 is connected, via the aforementioned coupling joint 12, to the cam shaft that is a structural member of the engine. Therefore, when the cam shaft rotates, the rotating shaft 40 rotates (power is transmitted thereto) via the coupling joint 12.

Note that the rotating shaft 40 is a member to which power of the engine is transmitted from the cam shaft via the coupling joint 12. Therefore, from the standpoint of strength, the rotating shaft 40 is formed from a metal material (e.g., iron, aluminum). Note that the rotating shaft may be formed of resin, provided that sufficient strength can be ensured.

In the present embodiment, the rotating shaft 40 and the cam shaft are connected by using the coupling joint 12, but the present invention is not limited to this structure. For example, there may be a structure in which the rotating shaft 40 and the cam shaft are connected directly without using the coupling joint 12.

As shown in FIG. 2 and FIG. 3, the vane 50 that is plate-shaped is inserted and disposed within the groove 45 of the supporting portion 44. Both plate surfaces 50A of this vane 50 are supported by groove walls 45A of the groove 45 so as to freely move reciprocally in the direction (the diameter direction of the rotating shaft 40) orthogonal to the rotating shaft 40. Due thereto, the vane 50 rotates integrally with the rotating shaft 40.

Due to the vane 50 rotating integrally with the rotating shaft 40, the vane 50 moves reciprocally in the diameter direction of the rotating shaft 40 due to centrifugal force, and both end portions 50B in the length direction respectively slide on the inner wall surface 22A while being pushed against the inner wall surface 22A of the housing 20. At this time, one side portion 50C in the transverse direction of the vane 50 slides on the blocking surface of the cover body 38, and the other side portion in the transverse direction slides on the bottom surface 24A.

Further, the vane 50 sections the interior of the housing 20 (the pump chamber 36 interior) into plural spaces. There is a structure in which, accompanying the rotation of the vane 50, the volumes of the spaces that are sectioned by the vane 50 gradually become smaller from the intake portion 30 side toward the discharging portion 34 side. Namely, the volumes of the spaces, that are sectioned by the vane 50, vary due to rotation of the vane 50.

Note that, although the vane 50 is formed of resin in the present embodiment, the present invention is not limited to this structure, and the vane may be formed of metal.

Figure 6:
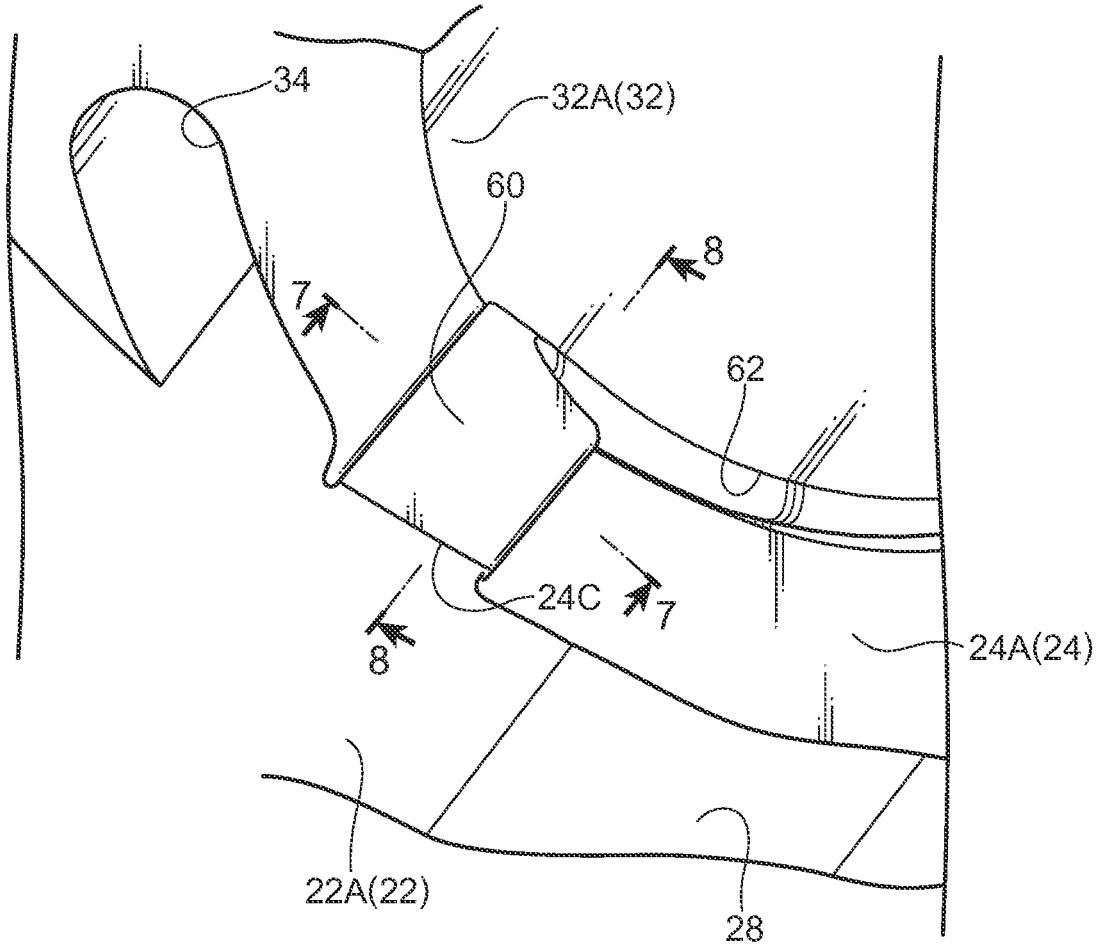
FIG. 6 is an enlarged perspective view that is seen obliquely from above and in which the portion, that is indicated by arrow 6X of the housing in FIG. 4, is enlarged.

As shown in FIG. 2, FIG. 4 and FIG. 6, the concave portion 60 that communicates with the circular hole 32 is formed in the bottom surface 24A of the housing 20, between the discharging portion 34 and the curved surface 28 in the vane rotating direction. This concave portion 60 receives the lubricant that is moved by the vane 50, and guides the lubricant to the circular hole 32. Concretely, the concave portion 60 guides the lubricant that is received at the concave portion 60, or in other words, the lubricant that has entered into the concave portion 60, along the concave bottom surface thereof to the circular hole 32.

Further, the concave portion 60 extends from the edge portion of the circular hole 32 to a boundary 24C between the inner wall surface 22A and the bottom surface 24A. Note that the boundary 24C may also be called the end portion at the outer peripheral side of the bottom surface 24A.

Figure 7:
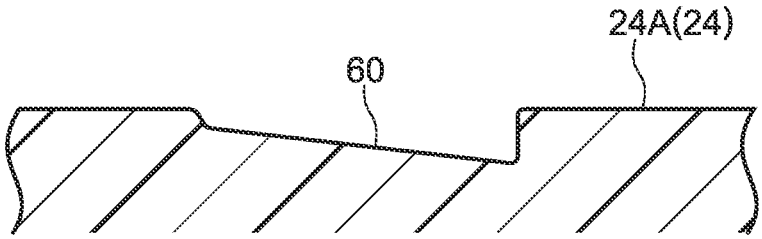
FIG. 7 is a cross-sectional view along line 7X-7X of a concave portion of the housing of FIG. 6.

As shown in FIG. 7, as seen in a cross-section along the peripheral direction of the bottom portion 24, the depth of the concave portion 60 from the bottom surface 24A becomes gradually deeper from the vane rotating direction upstream side toward the downstream side. Note that the present invention is not limited to the above-described structure, and the depth of the concave portion 60 from the bottom surface 24A may be made to be the same depth at the vane rotating direction upstream side and downstream side.

Figure 8:
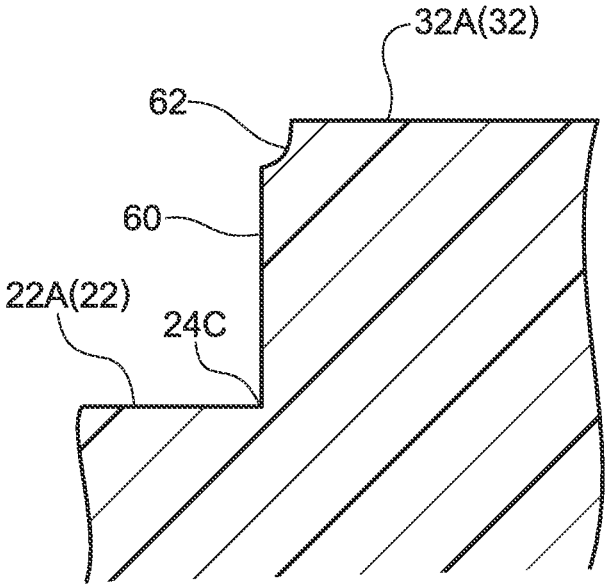
FIG. 8 is a cross-sectional view along line 8X-8X of the concave portion of the housing of FIG. 6.

As shown in FIG. 8, as seen in a cross-section along the radial direction of the bottom portion 24, the depth of the concave portion 60 from the bottom surface 24A is made to be the same depth from the edge portion of the circular hole 32 to the boundary 24C.

As shown in FIG. 2 and FIG. 5, the hole side groove portion 62, that communicates the concave portion 60 and the exterior of the housing 20 is formed in the hole wall surface 32A of the circular hole 32. This hole side groove portion 62 extends in a spiral form along the hole wall surface 32A. Concretely, the hole side groove portion 62 is made to be a spiral form that circles in the same direction as the vane rotating direction, from the concave portion 60 side of the circular hole 32 toward the opposite side. In other words, the hole side groove portion 62 is made to be a leftward-circling (counterclockwise) spiral form as seen from the cover body 38 side.

Further, the groove width and the groove depth of the hole side groove portion 62 of the present embodiment are made to be uniform from the one end thereof at the concave portion 60 side to the other end thereof at the side opposite the concave portion 60. However, the present invention is not limited to this structure. At least one of the groove width and the groove depth of the hole side groove portion 62 may be made to vary from the aforementioned one end to the aforementioned other end.

Operation and effects of the negative pressure pump 10 relating to the present embodiment are described next.

At the negative pressure pump 10, when power is transmitted from the engine that serves as a power source and the rotating shaft rotates, the vane 50 also rotates integrally with the rotating shaft 40. Due to this rotation, the vane 50 receives centrifugal force and moves in the direction orthogonal to the rotating shaft 40 (in the diameter direction of the rotating shaft), and the end portions 50B slide on the inner wall surface 22A of the housing 20. At this time, the one side portion 50C of the vane 50 slides on the blocking surface (the reverse surface) of the cover body 38, and the other side portion slides on the bottom surface 24A of the housing 20.

Here, because the rotational center C of the rotating shaft 40 is set at a position that is eccentric with respect to the housing center, when the rotating shaft 40 and the vane 50 rotate integrally, the volumes of the spaces that are sectioned by the vane 50 increase and decrease. Here, at the spaces that are sectioned by the vane 50, first, at the time when the volume increases, a gas is sucked-in from the intake portion 30, and next, at the time when the volume decreases, the sucked-in gas is discharged from the discharging portion 34 while being compressed. In this way, negative pressure can be generated at the device side due to a gas being sucked-in from the negative pressure-type brake booster device that is connected to the intake portion 30.

Here, at the negative pressure pump 10, the concave portion 60 is formed in the bottom surface 24A of the housing 20, between the discharging portion 34 and the curved surface 28 in the vane rotating direction. Therefore, the lubricant, that remains without having been completely discharged-out after the vane 50 has gone past the discharging portion 34, is received at the concave portion 60, or, in other words, the remaining lubricant enters into the concave portion 60. Because this concave portion 60 communicates with the circular hole 32, the lubricant that has entered-in is guided to the circular hole 32. Here, at a space (hereinafter called "closed space") 64 between the rotating shaft 40 (the supporting portion 44) and the vane 50 that has gone past the discharging portion 34, the pressure rises due to the decrease in volume. Therefore, the lubricant that has been guided to the circular hole 32 is, due to the pressure of the closed space 64 (see FIG. 3), pushed-into the gap between the hole wall surface 32A of the circular hole 32 and the outer peripheral surface 42A of the shaft portion 42. At this time, the gas, that remains without having being completely discharged-out, also mixes with the lubricant and is pushed into the aforementioned gap. Due thereto, a rise in pressure of the closed space 64 is suppressed, and therefore, excessive pressure being applied to the vane 50 is suppressed. As a result, breakage of the vane 50 is prevented.

Further, frictional resistance between the hole wall surface 32A of the circular hole 32 and the outer peripheral surface 42A of the shaft portion 42 is reduced due to the lubricant that has been pushed into the gap between the circular hole 32 and the shaft portion 42. Due thereto, wear of the hole wall surface 32A of the circular hole 32 and the outer peripheral surface 42A of the shaft portion 42 is suppressed. As a result, the durability of the negative pressure pump 10 improves.

Moreover, because rotation of the rotating shaft 40 is smooth due to the lubricant, energy loss of the engine also is suppressed.

Moreover, due to the rotation of the vane 50, lubricant and gas successively pass-through the concave portion 60, and are pushed into the gap between the circular hole 32 and the shaft portion 42, and then, are pushed-out to the exterior of the housing 20. Therefore, effects of the lubricant, that remains without having been completely discharged-out, on the intake amount of the gas that is sucked-in from the intake portion 30 (the sucked-in amount) are reduced, and thus, a decrease in the pump efficiency can be suppressed.

Further, at the negative pressure pump 10, the hole side groove portion 62, that communicates the concave portion 60 and the exterior of the housing 20, is formed in the hole wall surface 32A of the circular hole 32. Therefore, the lubricant, that has passed-through the concave portion 60 and been guided to the circular hole 32, is, by the pressure of the closed space 64, pushed into the hole side groove portion 62 that structures the gap between the circular hole 32 and the shaft portion 42. By forming the hole side groove portion 62 in the hole wall surface 32A of the circular hole 32 in this way, the pushed-out amount (discharged amount) of lubricant and gas from the closed space 64 increases, and therefore, a rise in the pressure of the closed space 64 can be suppressed further. Further, a decrease in the pump efficiency also can be suppressed further.

Further, the hole side groove portion 62 is formed in a spiral form that circles in the same direction and the vane rotating direction, from the concave portion 60 side of the circular hole 32 toward the side opposite this concave portion 60. Therefore, due to rotation of the rotating shaft 40 (the shaft portion 42), force in the vane rotating direction is applied to the lubricant that is within the hole side groove portion 62. Due thereto, the lubricant passes-through the interior of the hole side groove portion 62, and is guided and discharged-out to the exterior of the housing 20.

Further, because the concave portion 60 extends from the edge portion of the circular hole 32 to the boundary 24C between the inner wall surface 22A and the bottom surface 24A, the lubricant that is in the vicinity of the boundary 24C also enters into the concave portion 60. Due thereto, more lubricant can be discharged through the concave portion 60 from the gap (including the hole side groove portion 62) between the circular hole 32 and the shaft portion 42 to the exterior of the housing 20.

Due to the above, in accordance with the negative pressure pump 10 of the present embodiment, a decrease in the pump efficiency can be suppressed while the application of excessive pressure to the vane 50 is suppressed.

In the negative pressure pump 10, the lubricant that is sent from the cam shaft passes-through the through-hole 48 and is supplied to the interior of the housing 20, and thereafter, the supplied lubricant passes-through the gap (including the hole side groove portion 62) between the circular hole 32 and the shaft portion 42, and is discharged to the exterior. Therefore, in the negative pump 10 of the present embodiment, the structure of the rotating shaft 40 is a simple structure as compared with, for example, a conventional pump in which, in order to place lubricant between the circular hole 32 and the shaft portion 42, a flow path, the branches-off from midway along the through-hole 48 and opens at the outer peripheral surface 42A of the shaft portion 42, or the like is formed at the rotating shaft 40. Due thereto, an increase in the manufacturing cost of the rotating shaft 40 can be suppressed.

Further, at the negative pressure pump 10, because the housing 20 is formed of resin, an increase in the manufacturing cost of and the weight of the housing 20 are kept down as compared with, for example, a structure in which the housing is formed of metal. In particular, molding of the concave portion 60 and the hole side groove portion 62 are facilitated by forming the housing 20 of resin.

Figure 9:
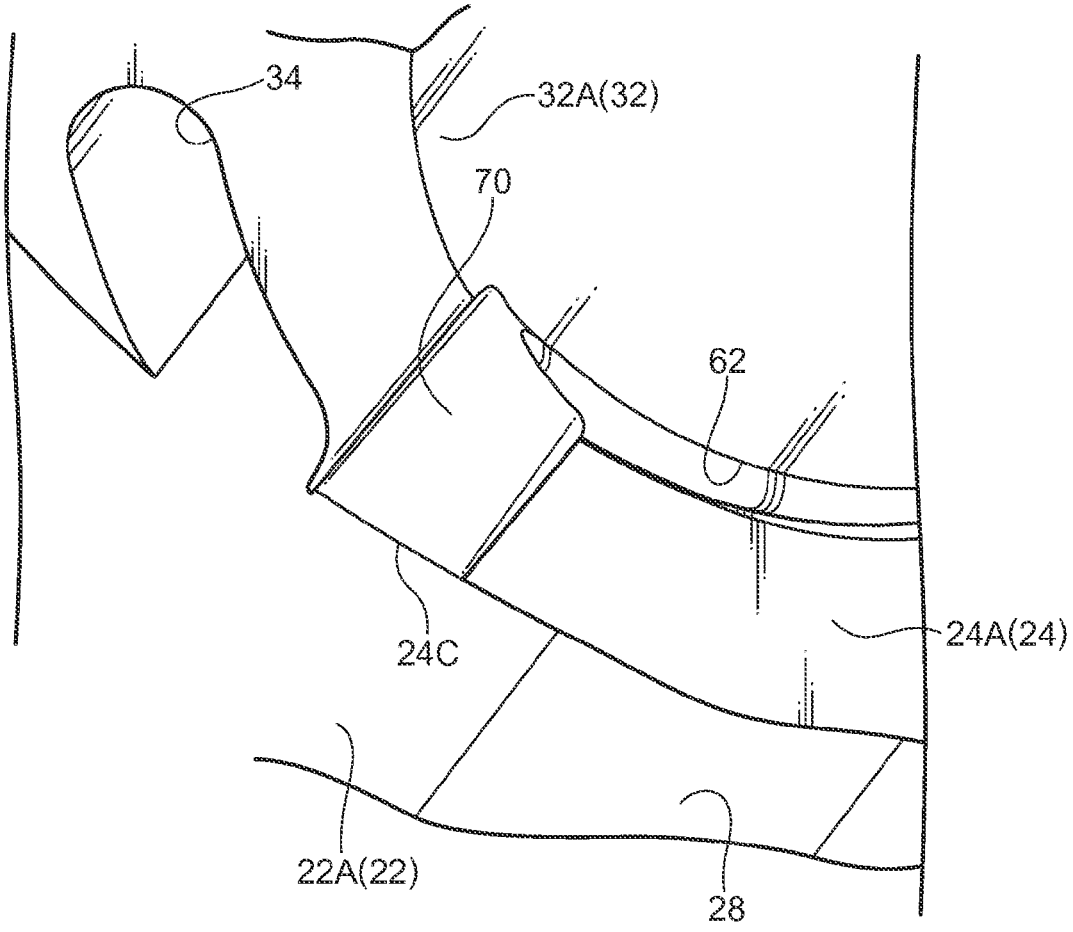
FIG. 9 is an enlarged perspective view showing a first modified example of the concave portion formed at the housing of the first embodiment.

In the negative pressure pump 10 of the present embodiment, as shown in FIG. 8, the depth of the concave portion 60 from the bottom surface 24A is made to be the same depth from the edge portion of the circular hole 32 to the boundary 24C, as seen in a cross-section along the radial direction of the bottom portion 24. However, the present invention is not limited to this structure. For example, as at a concave portion 70 of a first modified example that is shown in FIG. 9, there may be a structure in which the depth of the concave portion 60 from the bottom surface 24A is made to be gradually more shallow from the edge portion of the circular hole 32 toward the boundary 24C. Due to this structure, the lubricant that has entered into the concave portion 70 can be guided smoothly to the circular hole 32. Note that the above-described structure can be applied also to the second embodiment and the third embodiment and the like that are described hereafter.

Figure 10:
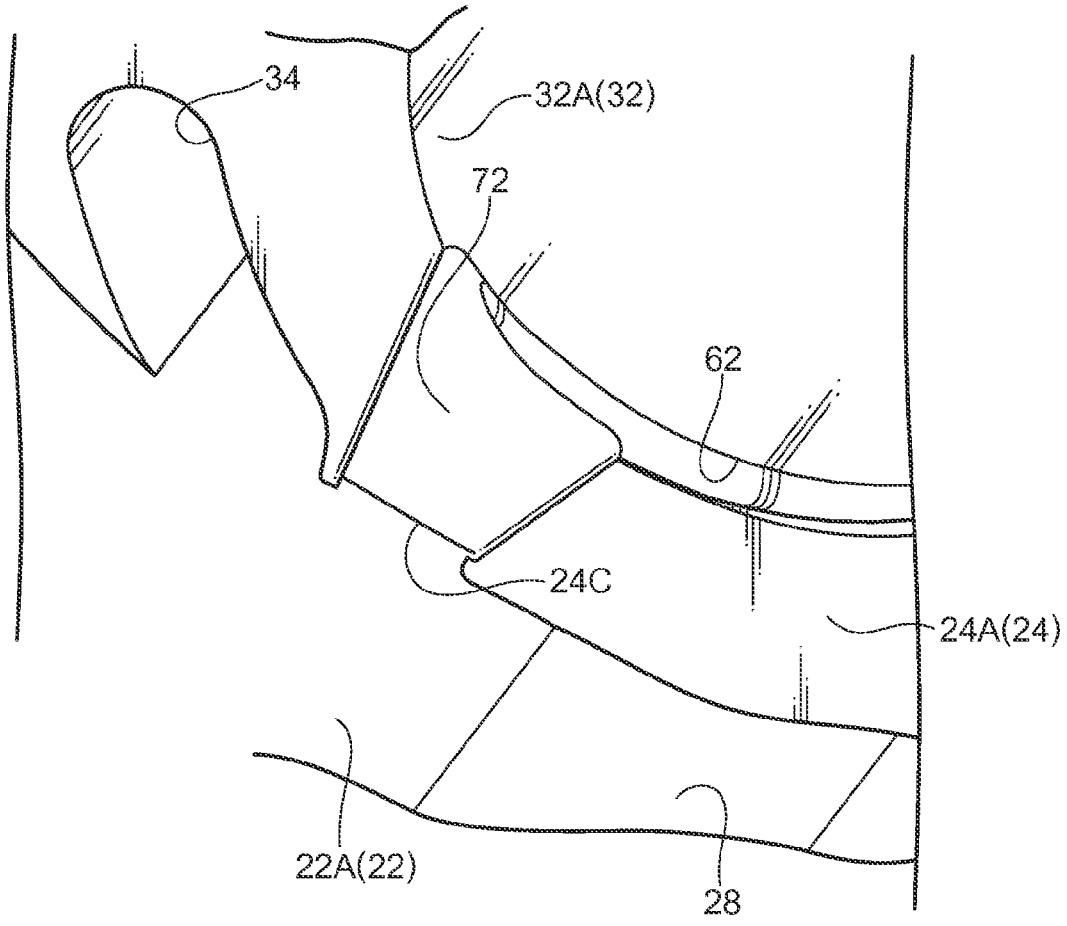
FIG. 10 is an enlarged perspective view showing a second modified example of the concave portion formed at the housing of the first embodiment.

Further, in the negative pressure pump 10 of the present embodiment, as shown in FIG. 6, the length, along the peripheral direction of the bottom portion 24, of the opening portion of the concave portion 60 that opens at the bottom surface 24A is made to be substantially uniform from the edge portion of the circular hole 32 to the boundary 24C. However, the present invention is not limited to this structure, and there may be a structure in which the length, along the peripheral direction, of this opening portion of the concave portion 60 is varied from the edge portion of the circular hole 32 to the boundary 24C. For example, as with a concave portion 72 of a second modified example that is shown in FIG. 10, there may be a structure in which the length, along the peripheral direction of the bottom portion 24, of the opening portion of the concave portion 72 that opens at the bottom surface 24A is made to become gradually shorter from the edge portion of the circular hole 32 toward the boundary 24C, or in other words, is made to become gradually longer from the boundary 24C toward the edge portion of the circular hole 32. Note that the above-described structure can be applied also to the second embodiment and the third embodiment and the like that are described later.

Moreover, in the negative pressure pump 10 of the present embodiment, there is a structure in which the hole side groove portion 62 extends in a spiral form that runs along the inner wall surface 22A, but the present invention is not limited to this structure. For example, there may be a structure in which the hole side groove portion extends in a rectilinear form along the axial direction of the tubular wall portion 22, or there may be a structure in which the hole side groove portion extends in the form of curve (as an example, a wavy form) in the axial direction of the tube wall portion. Further, there may be a structure in which the hole side groove portion (including the hole side groove portion 62) branches-off into plural portions in the midst of heading from the concave portion 60 side toward the side opposite the concave portion 60.

Still further, in the negative pressure pump 10 of the present embodiment, as shown in FIG. 6, the discharging portion 34 and the concave portion 50 are disposed with an interval therebetween in the vane rotating direction (the discharging portion 34 and the concave portion 60 are independent), but the present invention is not limited to this structure. For example, a portion of the discharging portion 34 and the concave portion 60 may be connected. Note that the above-described structure can be applied also to the second embodiment and the third embodiment and the like that are described later.

Second Embodiment

A negative pressure pump 80 relating to a second embodiment of the present invention is described next. Note that description of structures that are the same as the negative pressure pump 10 of the first embodiment is omitted.

At the negative pressure pump 80 of the present embodiment, the hole side groove portion 62 is not formed in the hole wall surface 32A of the circular hole 32, and instead, shaft side groove portions 84 are formed in the outer peripheral surface 42A of the shaft portion 42 of the rotating shaft 82. Note that the other structures are structures that are the same as the first embodiment.

Figure 11:
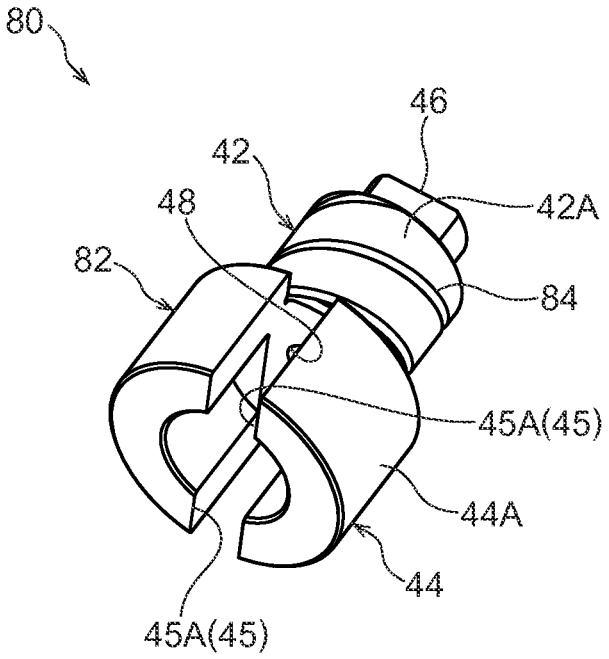
FIG. 11 is a perspective view of a rotating shaft that is used in a negative pressure pump of a second embodiment of the present invention.
Figure 12:
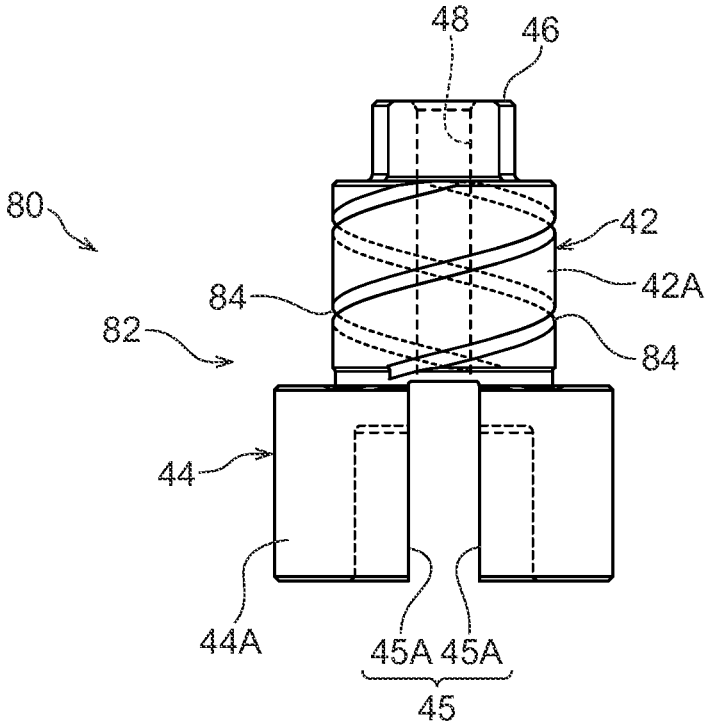
FIG. 12 is a plan view of the rotating shaft of FIG. 11.

As shown in FIG. 11 and FIG. 12, the shaft side groove portions 84 are structured so as to communicate the concave portion 60 and the exterior of the housing 20 when the vane 50 is positioned between the discharging portion 34 and the curved surface 28. Further, the shaft side groove portions 84 extend in spiral forms along the outer peripheral surface 42A of the shaft portion 42. Concretely, the shaft side groove portions 84 are made to be spiral forms that circle in the direction opposite the vane rotating direction (rightward-circling spiral forms), from the supporting portion 44 side toward the side opposite that. Further, during one rotation of the rotating shaft 82, the respective end portion 50B sides of the vane 50 go past the discharging portion 34, and therefore, the shaft side groove portions 84 are formed in the outer peripheral surface 42A of the shaft portion 42 at two places that are offset by one-half of the periphery.

Operation and effects of the negative pressure pump 80 of the present embodiment are described next. Note that description of the operation and effects that are obtained by the negative pressure pump 10 of the first embodiment is omitted.

At the negative pressure pump 80, the shaft side groove portions 84, that communicate the concave portion 60 and the exterior of the housing 20 when the vane 50 is positioned between the discharging portion 34 and the curved surface 28, are formed in the outer peripheral surface 42A of the shaft portion 42. Therefore, the lubricant, that has passed-through the concave portion 60 and been guided to the circular hole 32, is, by the pressure of the closed space 64, pushed-into the shaft side groove portions 84 that structure gaps between the hole wall surface 32A of the circular hole 32 and the outer peripheral surface 42A of the shaft portion 42. By forming the shaft side groove portions 84 in the outer peripheral surface 42A of the shaft portion 42 in this way, the pushed-out amount (discharged amount) of lubricant and gas from the closed space 64 further increases, and therefore, a rise in the pressure of the closed space 64 can be suppressed further. Further, a decrease in the pump efficiency also can be suppressed further.

Further, at the negative pressure pump 80, the shaft side groove portions 84 are formed in spiral forms that circle in the direction opposite the vane rotating direction, from the supporting portion 44 side toward the side opposite the supporting portion 44. Therefore, due to rotation of the rotating shaft 82 (the shaft portion 42), force in the direction opposite the vane rotating direction is applied to the lubricant that is within the shaft side groove portions 84. Due thereto, the lubricant passes-through the interiors of the shaft side groove portions 84, and is guided and discharged-out to the exterior of the housing 20.

The groove width and the groove depth of the shaft side groove portions 84 of the present embodiment are made to be uniform from the one ends thereof at the supporting portion 44 side to the other ends thereof at the side opposite the supporting portion 44. However, the present invention is not limited to this structure. At least one of the groove width and the groove depth of the shaft side groove portion 84 may be made to vary from the aforementioned one end to the aforementioned other end.

In the negative pressure pump 80 of the present embodiment, there is a structure in which the shaft side groove portions 84 extend in spiral forms that run along the outer peripheral surface 42A of the shaft portion 42, but the present invention is not limited to this structure. For example, there may be a structure in which the shaft side groove portions 84 extend in rectilinear forms along the axial direction of the rotating shaft 82, or there may be a structure in which the shaft side groove portions 84 extend in the forms of curves (as an example, wavy forms) in the axial direction of the rotating shaft 82. Further, there may be a structure in which the shaft side groove portions (including the shaft side groove portions 84) branch-off into plural portions in the midst of heading from the supporting portion 44 side toward the side opposite the supporting portion 44.

Further, the structure relating to the shaft side groove portions 84 of the rotating shaft 82, that is used in the negative pressure pump 80 of the present embodiment, may be applied to the rotating shaft 40 of the first embodiment. In this case, excessive pressure being applied to the vane 50 is further suppressed by the hole side groove portion 62 and the shaft side groove portions 84, and a decrease in the pump efficiency can be suppressed further.

Third Embodiment

A cylinder head cover 100 relating to a third embodiment of the present invention is described next.

Figure 13:
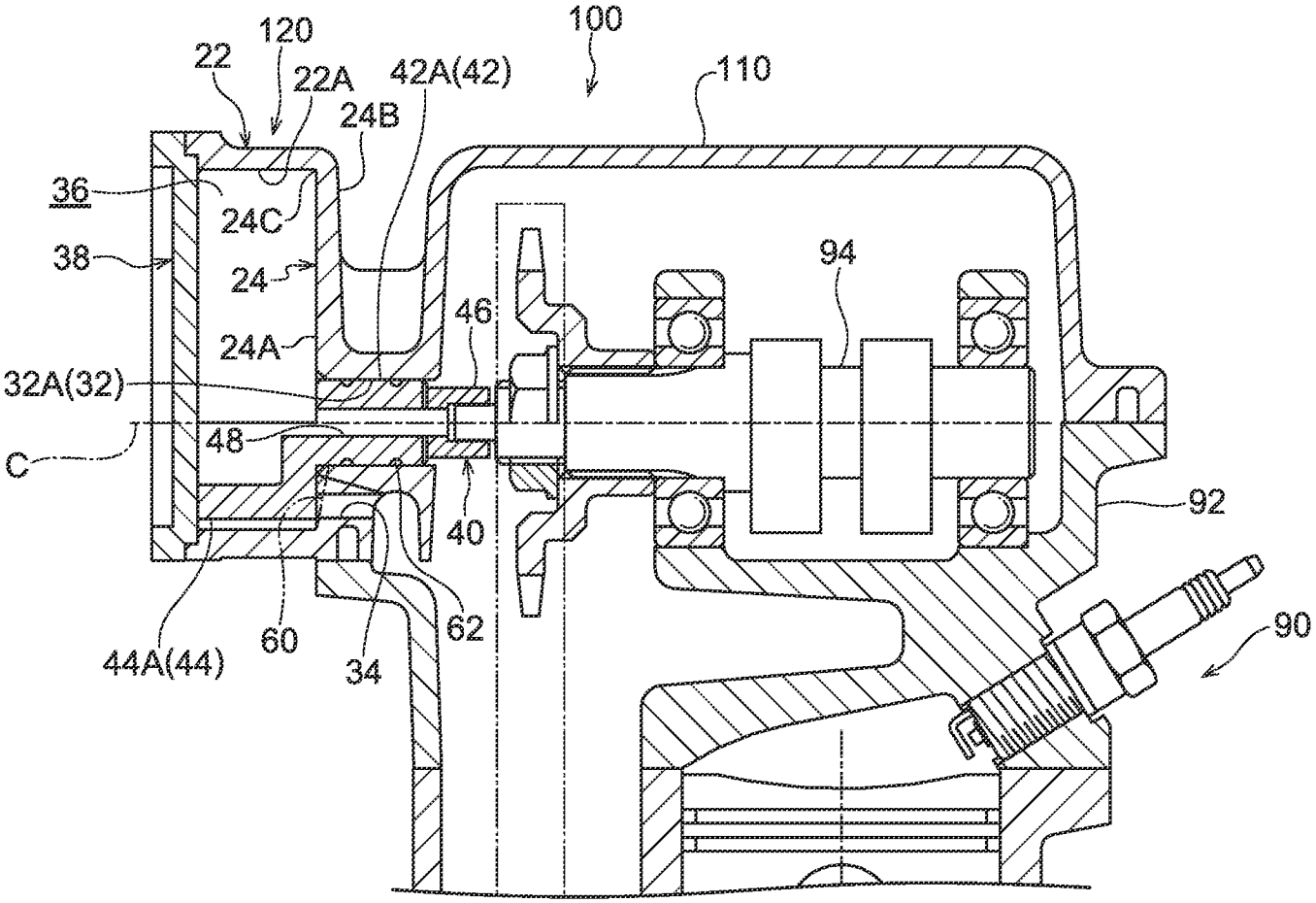
FIG. 13 is a cross-sectional view, that is cut along the axial direction, of a negative pressure pump housing portion of a cylinder head cover of a third embodiment.

The cylinder head cover 100 of the present embodiment is formed of resin, and concretely, of the same resin as the housing 20 of the first embodiment. Further, as shown in FIG. 13, a portion of the cylinder head cover 100 is made to be a negative pressure pump housing portion 120 that has a shape similar to the housing 20 of the negative pressure pump 10 of the first embodiment, and the other portion is made to be a cover portion 110 that covers a cylinder head 92 of an engine 90 that serves as a power source.

Pump structural members such as the cover body 38, the rotating shaft 40, the vane 50 and the like are mounted to the negative pressure pump housing portion 120, in the same way as in the negative pressure pump 10 of the first embodiment. Due thereto, a negative pressure pump portion, that is similar to the negative pressure pump 10 of the first embodiment, is structured at the cylinder head cover 100. Note that, in the present embodiment, the rotating shaft 40 and a cam shaft 94 are directly connected.

Operation and effects of the cylinder head cover 100 of the present embodiment are described next.

Because a portion of the cylinder head cover 100 is made to be the negative pressure pump housing portion 120, manufacturing costs can be reduced as compared with, for example, a structure in which the cylinder head cover and the negative pressure pump 10 are made to be separate as in the first embodiment.

A negative pressure pump portion, that is similar to the negative pressure pump 10 of the first embodiment, is formed at the cylinder head cover 100 of the present embodiment. However, a negative pressure pump portion, that is similar to the negative pressure pump 80 of the second embodiment, may be formed. Further, instead of the rotating shaft 40, the rotating shaft 82 of the second embodiment may be used.

Other Embodiments

Figure 14:
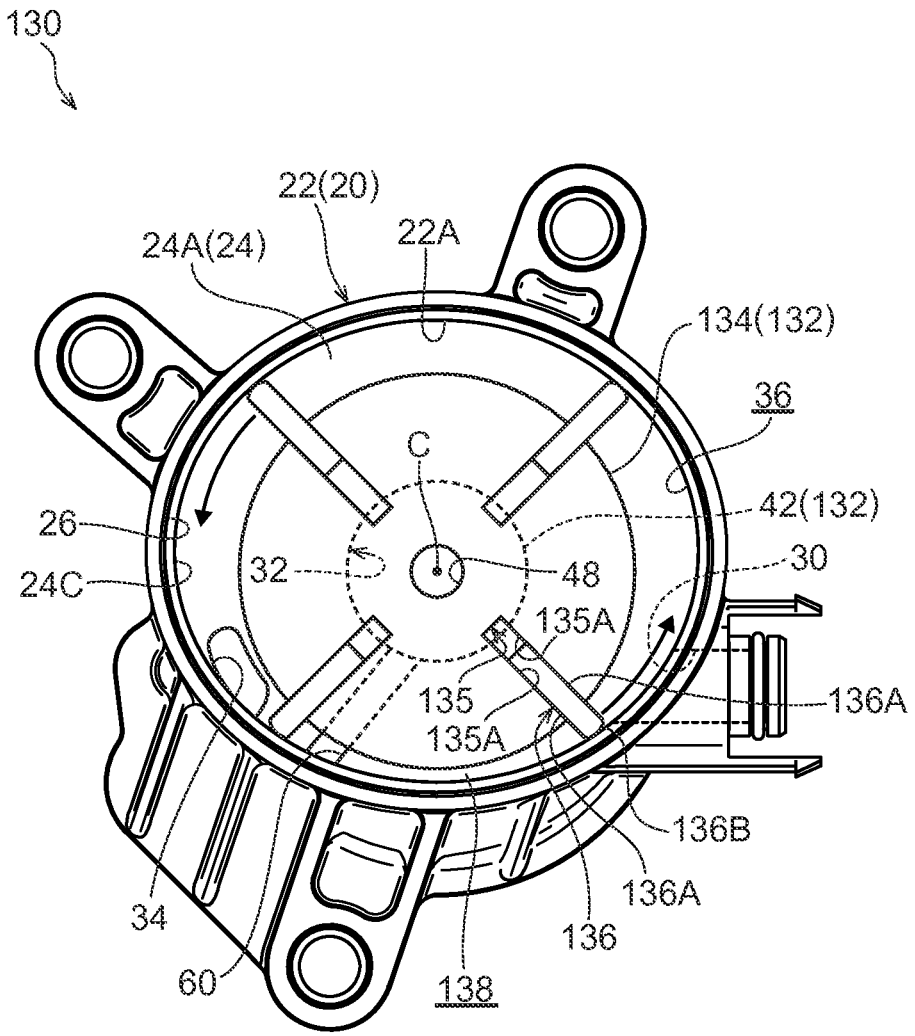
FIG. 14 is a front view of a state in which the cover body of a negative pump of another embodiment of the present invention has been removed.

As shown in FIG. 3, in the negative pressure pump 10 of the first embodiment, the supporting portion 44 of the rotating shaft 40 abuts a portion of the inner wall surface 22A of the housing 20, and supports the one vane 50. However, the present invention is not limited to this structure. For example, as with a negative pressure pump 130 of another embodiment that is shown in FIG. 14, there may be a structure in which a supporting portion 134 of a rotating shaft 132 does not abut the inner wall surface 22A of the housing 20, and the supporting portion 134 supports three or more (four in FIG. 14) vanes 136. This negative pressure pump 130 has a structure that is the same as the negative pressure pump 10 of the first embodiment, other than the structures of the supporting portion 134 of the rotating shaft 132 and the vanes 136 and the placement and position of the concave portion 60 as described above, and therefore, description is omitted. The supporting portion 134 structures one end side in the axial direction of the rotating shaft 132, and, at the center thereof, the through-hole 48 extends from the shaft portion 42. Further, three or more (four in FIG. 14) grooves 135 that extend in the axial direction are formed in the outer periphery of the supporting portion 134 at intervals in the peripheral direction. The vanes 136 that are plate-shaped are inserted and disposed in these grooves 135. Both plate surfaces 136A of these vanes 136 are supported by groove walls 135A of the grooves 135 so as to freely move reciprocally in the direction (the diameter direction of the rotating shaft 132) orthogonal to the rotating shaft 132. Due thereto, the vanes 136 rotate integrally with the rotating shaft 132. Further, due to the vanes 136 rotating integrally with the rotating shaft 132, the vanes 136 move reciprocally in the diameter direction of the rotating shaft 132 due to centrifugal force, and end portions 136B respectively slide on the inner wall surface 22A while being pushed against the inner wall surface 22A of the housing 20. At this time, one side portions in the transverse directions of the vanes 136 slide on the blocking surface of the cover body 38, and the other side portions in the transverse directions slide on the bottom surface 24A. Moreover, the vanes 136 section the interior of the housing 20 (the interior of the pump chamber 36) into plural spaces. There is a structure in which the volumes of the spaces, that are sectioned by the vanes 136, gradually become smaller from the intake portion 30 side toward the discharging portion 34 side, accompanying the rotation of the vanes 136. Namely, the volumes of the spaces, that are sectioned by the vanes 136, vary due to rotation of the vanes 136. Note that the placement interval of the vanes 136 is set so as to be more narrow than the interval between the intake portion 30 and the discharging portion 34 in the vane rotating direction. In other words, as shown in FIG. 14, the placement interval of the vanes 136 is set such that two of the vanes 136 that are adjacent to one another are disposed between the discharging portion 34 and the intake portion 30. Further, at the negative pressure pump 130, the concave portion 60 is formed in the bottom surface 24A, between the intake portion 30 and the discharging portion 34 in the vane rotating direction.

To describe operation of the negative pressure pump 130 next, in the negative pressure pump 130, the concave portion 60 is formed in the bottom surface 24A of the housing 20, between the discharging portion 34 and the intake portion 30 in the vane rotating direction. Therefore, the lubricant, that remains without having been completely discharged after the vane 136 has gone past the discharging portion 34, enters into the concave portion 60. Because this concave portion 60 communicates with the circular hole 32, the lubricant that has entered in is guided to the circular hole 32. Here, in a space (hereinafter called "closed space") 138 between the vane 136 that has gone past the discharging portion 34 and the vane 136 that went past the discharging portion 34 before that vane 136 and has not yet reached the intake portion 30, the pressure rises due to a decrease in volume. Therefore, the lubricant, that has been guided to the circular hole 32, is, by the pressure of the closed space 138, pushed into the gap between the hole wall surface 32A of the circular hole 32 and the outer peripheral surface 42A of the shaft portion 42. At this time, the gas, that remains without having been completely discharged, also mixes with the lubricant and is pushed into the aforementioned gap. Due thereto, a rise in the pressure of the closed space 138 is suppressed, and thus, excessive pressure being applied to the vanes 136 is suppressed. As a result, breakage of the vanes 136 is prevented. Note that other operation and effects are similar to those of the negative pressure pump 10 of the first embodiment. Further, the structure of the negative pressure pump 130 may be applied to the negative pressure pump 80 of the second embodiment and to the negative pressure pump portion of the cylinder head cover of the third embodiment.

Note that, although specific embodiments of the present invention have been described in detail, the present invention is not limited to these embodiments, and it will be clear to those skilled in the art that various other embodiments are possible within the scope of the present invention.

Note that the disclosure of Japanese Patent Application No. 2013-242292 that was filed on Nov. 22, 2013 is, in its entirety, incorporated by reference into the present specification.

All publications, patent applications, and technical standards mentioned in the present specification are incorporated by reference into the present specification to the same extent as if such individual publication, patent application, or technical standard was specifically and individually indicated to be incorporated by reference.

The invention claimed is:

1. A negative pressure pump comprising:

a housing that is formed in a shape of a tube having a bottom, and at which an opening portion is blocked by a cover body, and to whose interior lubricant is supplied, and in which a circular hole is formed at a position of a bottom portion, the position being eccentric from a housing center;

a rotating shaft having a shaft portion that is fit-together with the circular hole, and having a supporting portion, whose diameter is larger than the shaft portion and that is disposed within the housing and whose outer peripheral surface contacts a portion of an inner wall surface of the housing, the rotating shaft rotating due to power being transmitted thereto from a power source;

a vane that is disposed within the housing, and that is supported at the supporting portion of the rotating shaft so as to freely move reciprocally in a direction orthogonal to the rotating shaft, and that rotates integrally with the rotating shaft, and whose end portions slide on the inner wall surface, and that sections an interior of the housing into a plurality of spaces;

an intake portion that is formed in the housing and takes a gas into the housing;

a discharging portion that is formed further toward a rotating direction downstream side of the vane than the intake portion of the housing, and that discharges gas, that has been sucked-in from the intake portion, and the lubricant to an exterior of the housing; and a concave portion that is formed in a bottom surface of the housing and, in a rotating direction of the vane, between the discharging portion and a portion of the inner wall surface that the supporting portion contacts, and that communicates with the circular hole, and guides the lubricant, that is moved by the vane, to the circular hole.

2. A negative pressure pump comprising:

a housing that is formed in a shape of a tube having a bottom, and at which an opening portion is blocked by a cover body, and to whose interior lubricant is supplied, and in which a circular hole is formed at a position of a bottom portion, the position being eccentric from a housing center;

a rotating shaft having a shaft portion that is fit-together with the circular hole, and having a supporting portion, whose diameter is larger than the shaft portion and that is disposed within the housing, the rotating shaft rotating due to power being transmitted thereto from a power source;

three or more vanes that are disposed within the housing, and that are supported at the supporting portion of the rotating shaft so as to freely move reciprocally in a direction orthogonal to the rotating shaft, and that rotate integrally with the rotating shaft, and whose end portions slide on an inner wall surface of the housing, and that section an interior of the housing into a plurality of spaces;

an intake portion that is formed in the housing and takes a gas into the housing;

a discharging portion that is formed further toward a rotating direction downstream side of the vanes than the intake portion of the housing, and that discharges gas, that has been sucked-in from the intake portion, and the lubricant to an exterior of the housing; and a concave portion that is formed in a bottom surface of the housing and, in a rotating direction of the vanes, between the discharging portion and the intake portion, and that communicates with the circular hole, and guides the lubricant, that is moved by the vanes, to the circular hole.

3. The negative pressure pump of claim 1, comprising a hole side groove portion that is formed in a hole wall surface of the circular hole, and that communicates the concave portion and the exterior of the housing.

4. The negative pressure pump of claim 3, wherein the hole side groove portion is formed in a spiral form that circles in a same direction as the rotating direction of the vane, from a concave portion side of the circular hole toward a side opposite the concave portion.

5. The negative pressure pump of claim 1, wherein the concave portion extends from an edge portion of the circular hole to a boundary between the inner wall surface and the bottom surface.

6. The negative pressure pump of claim 1, comprising a shaft side groove portion that is formed in an outer peripheral surface of the shaft portion, and that communicates the concave portion with the exterior of the housing when the vane is positioned between the discharging portion and the portion of the inner wall surface that the supporting portion contacts.

7. The negative pressure pump of claim 6, wherein the shaft side groove portion is formed in a spiral form that circles in a direction that is opposite from the rotating direction of the vane, from a supporting portion side of the shaft portion toward a side that is opposite from the supporting portion.

8. A cylinder head cover comprising the negative pressure pump of claim 1, wherein a portion of the cylinder head cover structures the housing, and another portion of the cylinder head cover covers a cylinder head of an engine that serves as the power source.

* * * * *